US006920653B2

(12) United States Patent
Selover

(10) Patent No.: US 6,920,653 B2
(45) Date of Patent: Jul. 26, 2005

(54) DISINFECTANT DELIVERY CHAMBER FOR USE IN WHIRLPOOL BATH

(75) Inventor: Craig W. Selover, Farmington Hills, MI (US)

(73) Assignee: Masco Corporation, Taylor, MI (US)

( * ) Notice: Subject to any disclaimer, the term of this patent is extended or adjusted under 35 U.S.C. 154(b) by 8 days.

(21) Appl. No.: 10/459,665

(22) Filed: Jun. 11, 2003

(65) Prior Publication Data

US 2004/0250344 A1 Dec. 16, 2004

(51) Int. Cl.[7] ..... E04H 4/00
(52) U.S. Cl. ..... 4/507; 4/504; 210/169
(58) Field of Search ..... 4/507, 504, 222, 4/222.1, 286–295, 652, DIG. 14, 162, 163, 169, 446, 416.1, 416.2, 460

(56) References Cited

U.S. PATENT DOCUMENTS 568,195 A * 9/1896 Franklin ..... 4/286
852,044 A * 4/1907 Van Der Minden ..... 4/222
3,677,711 A * 7/1972 Bond ..... 210/169
4,115,878 A * 9/1978 Johnson et al. ..... 4/292
6,395,167 B1 5/2002 Mattson, Jr. et al.
6,760,931 B1 7/2004 Mattson

FOREIGN PATENT DOCUMENTS

EP 0180451 A2 * 5/1986

* cited by examiner

*Primary Examiner*—Khoa D. Huynh
(74) *Attorney, Agent, or Firm*—Carlson, Gaskey & Olds

(57) ABSTRACT

An inventive suction cover for a whirlpool bath includes a rearwardly extending disinfectant chamber. The disinfectant chamber is filled with a supply of a disinfectant. As the whirlpool is operated, water is drawn into the disinfectant chamber and mixes with the disinfectant. This water then passes through an outlet hole and into the suction passage along with the greater volume flow of water having passed through the suction cover. The invention allows the retrofitting of a disinfectant chamber into existing whirlpool bath designs, and further ensures a greater likelihood of presence of disinfectant in the suction line at shutdown for draining of the whirlpool.

2 Claims, 2 Drawing Sheets

DISINFECTANT DELIVERY CHAMBER FOR USE IN WHIRLPOOL BATH

BACKGROUND OF THE INVENTION

This invention relates to the use of a disinfectant containing chamber to efficiently add disinfectant to a water suction line in a whirlpool bath.

Whirlpool baths typically include a number of jets for jetting water into a bath tub. The water is jetted into the bath tub at a relatively high velocity, and often intermixed with air. A pump applies a suction on a suction line that draws the water from the bath tub back to be recirculated through the jets.

Sometimes, after the whirlpool function is stopped, some water may remain in the suction line. Also, the whirlpool is typically capable of being utilized as a bath tub. When the bath tub function is being utilized, water can enter the suction line. For these reasons, it would be desirable to mix a disinfectant into the suction line for the whirlpool bath. However, the challenge of adding disinfectant to a whirlpool bath, and in particular to existing whirlpool baths has not been addressed as effectively as would be desired.

SUMMARY OF THE INVENTION

In a disclosed embodiment of this invention, the suction line for a whirlpool bath is provided with a disinfectant chamber. The disinfectant chamber is preferably exposed to a metered amount of water flowing toward the pump. The metered amount of water carries away an amount of disinfectant such that the disinfectant is metered into the suction line. The present invention thus provides a simple way of effectively adding the disinfectant to the suction line of a whirlpool bath. The disinfectant chamber is preferably incorporated into the suction line cover. The suction line cover may be retrofitted into existing whirlpool baths. As such, the present invention not only provides an efficient way of adding a disinfectant to future whirlpool bath designs, but also allows the addition of the disinfectant chamber to existing whirlpool baths.

The suction line cover preferably includes a large number of flow holes for guiding water through the suction line cover and to the pump. A metering hole is also formed in the suction line cover to allow water to reach the disinfectant. Preferably, the metering hole is smaller than the normal water flow holes. An outlet bleed hole is formed at another location on the disinfectant chamber downstream of the metering hole. Again, the outlet hole is preferably formed to be somewhat smaller than the water flow holes. The smaller inlet and outlet holes to and from the disinfectant chamber ensure that the disinfectant is metered into the suction line in a controlled fashion.

In a most preferred embodiment, the disinfectant chamber may be integrally molded with the cover, however, various other ways of attaching the chamber to the suction line cover may come within the scope of this invention.

These and other features of the present invention can be best understood from the following specification and drawings, the following of which is a brief description.

DETAILED DESCRIPTION OF A PREFERRED EMBODIMENT

Figure 1:
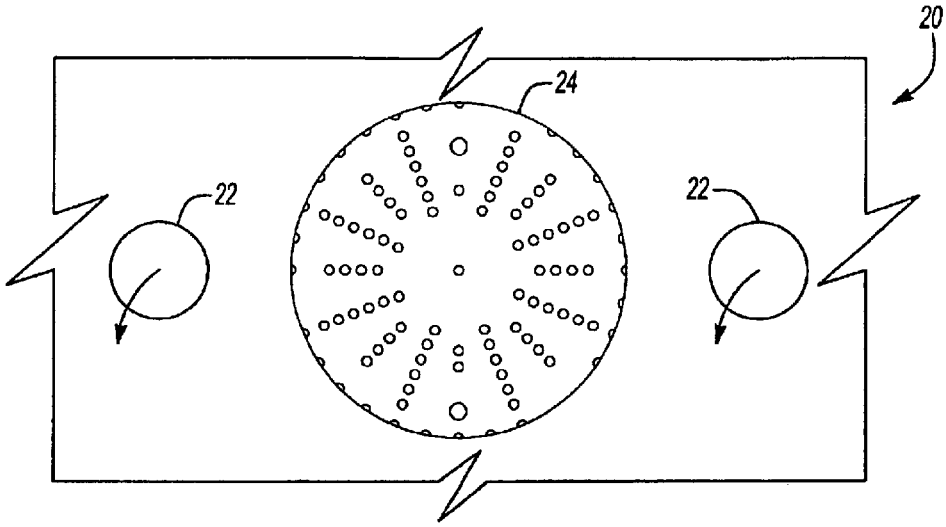
FIG. 1 is a schematic view of a wall in a whirlpool bath.

A whirlpool 20 is shown schematically in FIG. 1. As known, jets 22 drive a flow of water into a tub. The water is typically driven at a high velocity. The water may be mixed with air and it may be heated. A suction cover 24 overlies a suction passage and a pump. Water flows through the suction cover into the suction passage when the pump draws a pressure suction on the suction passage.

Figure 2:
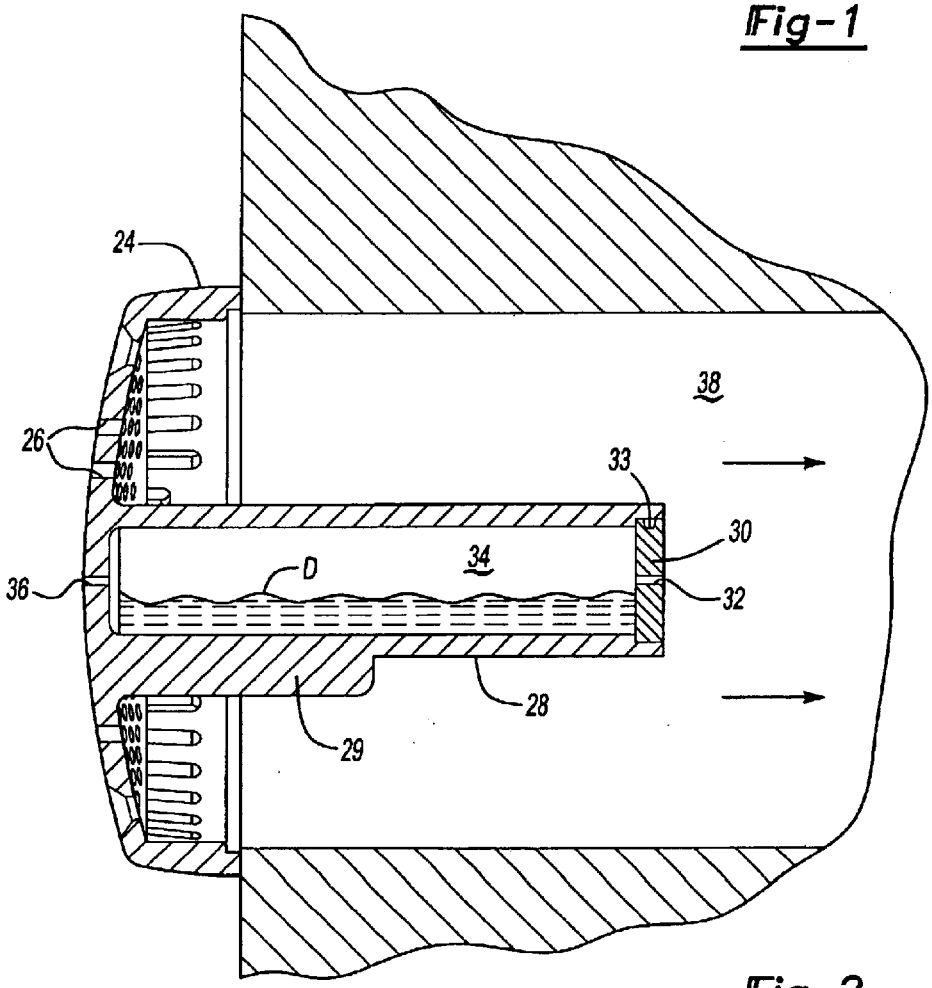
FIG. 2 is a cross-sectional view through a suction cover.

As shown in FIG. 2, the inventive suction cover 24 includes a number of flow holes 26 for allowing water to flow through the suction cover and into the suction passage 38. As also shown, a rearwardly extending chamber 28 extends from a front face of the cover. The rearwardly extending chamber 28 may include a number of ribs 29 for assisting and positioning the chamber when initially inserted.

A plug 30 is inserted at a rear end of the chamber 28 and may be removable from within an internal support surface 33 in the chamber 28. In a preferred embodiment, the plug is permanently attached to surface 33 through an adhesive such that it is not removable. This preferred embodiment would be disposable once the disinfectant has been depleted. An outlet hole 32 is formed through the plug 30. As shown, an internal chamber 34 receives a supply of a disinfectant D. An inlet hole 36 is formed in the front face of the suction cover 24. As is known, a pump is positioned downstream of the passage 38, or to the right as shown in FIG. 2. The pump will draw a suction on the tub, such that water will flow through the flow openings 26 and into the suction passage 38. A smaller amount of water would flow through the inlet hole 36 and into the chamber 34. This water mixes with the disinfectant D, and continues to flow through the outlet hole 32. As can be seen in FIG. 2. the inlet hole 36 and outlet hole 32 are significantly smaller than the normal water flow holes 26. This allows a controlled metering of the amount of disinfectant to being added to the water. A worker of ordinary skill in the art would recognize how to size the holes 36 and 32 to achieve a desired amount of metered flow.

Preferably, the size of the inlet hole 36 and the outlet hole 32 are selected to be sufficiently large so that water flowing through the chamber 28 even when the whirlpool pump is not being utilized will still carry an amount of disinfectant. That is, during the normal bath tub function, sufficient water will enter the chamber 28 and carry disinfectant D even though there is no vacuum or suction drawn on the suction line 38. Again, a worker in this art would recognize how to size the ports given this goal.

The disinfectant may be any disinfectant typically utilized in a human bath or other water which may contact a human. As an example, the disinfectant may be Bromine, Chlorine, or other disinfectants. The disinfectant may be in the form of a nugget or pellet shape.

As shown in FIG. 2, the chamber 28 is preferably molded with the front cover portion 24 as an integral part. However, the chamber may be otherwise attached to the cover.

Figure 3:
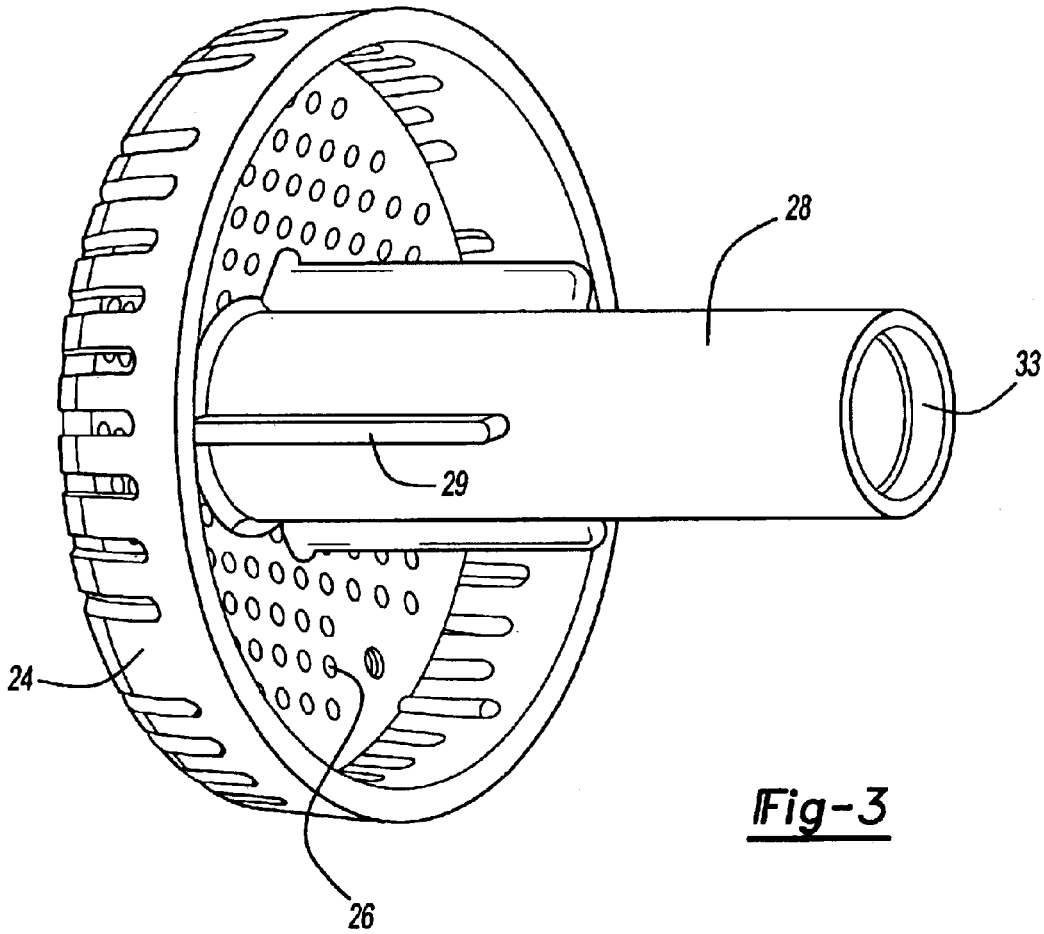
FIG. 3 is a perspective rear view of the suction cover.

As shown in FIG. 3, there are a plurality of ribs 29 formed from the chamber 28.

Adding the chamber onto the cover provides several benefits. As one main benefit, the flow will be into the suction line. At shutdown and draining of the tub, there will be disinfectant in the water which remains in the suction line. Also, as mentioned, the disinfectant will be directed into water flowing into the suction line even when the whirlpool is not being utilized.

Moreover, the use of the disinfectant chamber on a suction cover provides a simple way of retrofitting the chamber into existing whirlpool bath designs.

Although a preferred embodiment of this invention has been disclosed, a worker of ordinary skill in the art would recognize that certain modifications would come within the scope of this invention. For that reason, the following claims should be studied to determine the true scope and content of this invention.

What is claimed is:

1. A whirlpool bath comprising:

a wall including a plurality of jets;

a suction line; and a cover over said suction line, said cover having a front plate section with a plurality of flow holes for allowing water to pass through said front plate section and into said suction line, said cover having a rearwardly extending chamber, said rearwardly extending chamber being attached to said front plate section, an inlet hole for allowing water to flow into said chamber and an outlet hole for allowing water to flow outwardly from said rearwardly extending chamber, said chamber for receiving a disinfectant such that water can pass through said inlet hole, mix with said disinfectant and move outwardly of said outlet hole, said inlet hole and said outlet hole being smaller in size than said flow holes, said rearwardly extending chamber and said front plate section being integrally molded as a single part, said inlet hole is formed in said front plate section and said outlet hole is formed in an end of said rearwardly extending chamber remote from said front plate section such that water flowing into said inlet hole passes in the same general direction as water passing through said suction line and to said outlet hole, and said rearwardly extending chamber has radially outwardly extending ribs at an outer peripheral surface.

2. The whirlpool bath as set forth in claim 1, wherein said outlet hole is formed in a plug which inserts into an end opening in said rearwardly extending chamber, said plug being removable to allow resupply of said disinfectant.

* * * * *